US005332635A

United States Patent [19]

Tanaka

[11] Patent Number: 5,332,635

[45] Date of Patent: Jul. 26, 1994

[54] ELECTROPHOTOGRAPHIC PHOTOSENSITIVE MEMBER, AND ELECTROPHOTOGRAPHIC APPARATUS, DEVICE UNIT, AND FACSIMILE MACHINE EMPLOYING THE SAME

[75] Inventor: Hisami Tanaka, Yokohama, Japan

[73] Assignee: Canon Kabushik Kaisha, Tokyo, Japan

[21] Appl. No.: 964,299

[22] Filed: Oct. 21, 1992

[51] Int. Cl.[5] ..... G03G 5/05

[52] U.S. Cl. ..... 430/96; 430/59; 358/401

[58] Field of Search ..... 430/96, 57, 58, 59; 358/401

[56] References Cited

U.S. PATENT DOCUMENTS 4,877,701 10/1989 Hiro et al. ..... 430/59
5,080,989 1/1992 Gruenbaum et al. ..... 430/96
5,160,487 11/1992 Morishita et al. ..... 430/96

*Primary Examiner*—John Goodrow
*Attorney, Agent, or Firm*—Fitzpatrick, Cella, Harper & Scinto

[57] ABSTRACT

An electrophotographic photosensitive member is disclosed which has an electroconductive support and a photosensitive layer formed thereon. The photosensitive layer contains at least one polycarbonate selected from the group consisting of polycarbonates (1) to (3); and a charge-transportion substance having the structure represented by the formula (4) or (5) and having an oxidation potential of not less than 0.6 eV. Also, an electrophotographic apparatus, device unit and facsimile machine employing the electrophotographic photosensitive member are disclosed.

20 Claims, 1 Drawing Sheet

ELECTROPHOTOGRAPHIC PHOTOSENSITIVE MEMBER, AND ELECTROPHOTOGRAPHIC APPARATUS, DEVICE UNIT, AND FACSIMILE MACHINE EMPLOYING THE SAME

BACKGROUND OF THE INVENTION

1. Field of the Invention

The present invention relates to an electrophotographic photosensitive member. More particularly, the present invention relates to an electrophotographic photosensitive member comprising a photosensitive layer which contains a resin having a specified structure and a charge-transporting substance having a specified structure and a specified oxidation potential. The present invention further relates to an electrophotographic apparatus, a device unit, and a facsimile machine employing the above electrophotographic photosensitive member.

2. Related Background Art

In recent years, many electrophotographic photosensitive members have been reported and practically used which employ an organic photoconductive material which is a non-pollutant and permits high productivity, ease of material design, and future possibilities. These electrophotographic photosensitive members are naturally required to have suitable electric characteristics, suitable mechanical characteristics, and suitable optical characteristics for the electrophotographic process to which they are applied.

Since, a photosensitive member which is used repeatedly is exposed at the surface thereof repeatedly to electric and mechanical external forces such as corona discharge, toner development, image transfer to paper, and cleaning treatment, it is therefore required to have durability against these external forms. More specifically, the photosensitive member is required to be resistant to deterioration of characteristics caused by ozone generated at corona charging; namely deterioration of sensitivity, decrease of the surface potential and increase of the residual potential. The member should be resistant to abrasion and scratching of its surface caused by sliding elements on such surface during image transfer and cleaning.

The surface of the photosensitive member is usually constructed of an extremely thin resin layer, and the properties of the resin employed is one of the factors affecting greatly the electrophotographic characteristics of the photosensitive member. The resins which meet the above requirements and are conventionally used for the photosensitive member include a polycarbonate which is synthesized from a bisphenol having a 2,2-propylidene portion in the skeleton (hereinafter referred to as polycarbonate A), and a polycarbonate which is synthesized from a bisphenol having a cyclohexylidene portion in the skeleton (hereinafter referred to as polycarbonate Z).

The photosensitive member is usually formed by dispersing or dissolving a charge-generating substance or a charge-transporting substance, applying the resulting dispersion or solution on a support, and drying the applied matter. The resin film, especially a polycarbonate resin film, formed through such steps as above generally has residual stress in its internal structure, and is liable to cause solvent cracks disadvantageously. Thereby, on contact with a finger or oil during handling or fitting the member to an electrophotographic apparatus, the electrophotographic photosensitive member may develop cracks in the photosensitive layer. The formed cracks in the resin film may cause defects in the developed image.

With recent demand for high quality images and high durability of photosensitive members, electrophotographic photosensitive members have been studied for better solvent resistance in addition to electrophotographic characteristics.

SUMMARY OF THE INVENTION

An object of the present invention is to provide an electrophotographic photosensitive member which has excellent electrophotographic characteristics.

Another object of the present invention is to provide an electrophotographic photosensitive member which has excellent solvent resistance.

A further object of the present invention is to provide an electrophotographic apparatus, a device unit, and a facsimile machine which employ the electrophotographic photosensitive member.

The present invention provides an electrophotographic photosensitive member, comprising an electroconductive support and a photosensitive layer formed thereon, the photosensitive layer containing at least one polycarbonate selected from the group consisting of polycarbonates (1) to (3) below; and a charge-transporting substance having the structure represented by the formula (4) or (5) and having an oxidation potential of not less than 0.6 eV, (1) a copolymerized polycarbonate having the symmetric constitutional unit (a) below:

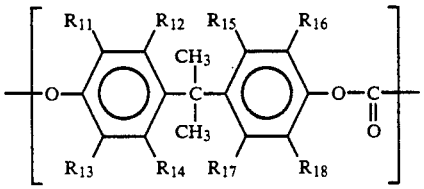

(a)

where $R_{11}$ to $R_{18}$ are respectively a hydrogen atom, a substituted or unsubstituted alkyl group, a substituted or unsubstituted alkoxy group, a substituted or unsubstituted aryl group, or a halogen atom, and the asymmetric constitutional unit (b) below:

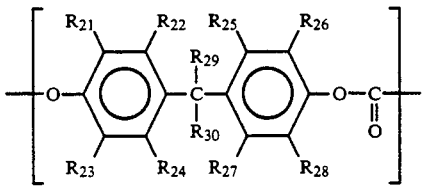

(b)

where $R_{21}$ to $R_{28}$ are respectively a hydrogen atom, a substituted or unsubstituted alkyl group, a substituted or unsubstituted alkoxy group, a substituted or unsubstituted aryl group, or a halogen atom, and $R_{29}$ and $R_{30}$ are respectively a hydrogen atom, a substituted or unsubstituted alkyl group, or a substituted or unsubstituted aryl group, or $R_{29}$ and $R_{30}$ may form a substituted or unsubstituted cycloalkylidene group by linking together;

(2) a copolymerized polycarbonate having two or more asymmetric constitutional units represented by the formula (b) above;

(3) a polycarbonate having a symmetric constitutional unit represented by the formula (c) below:

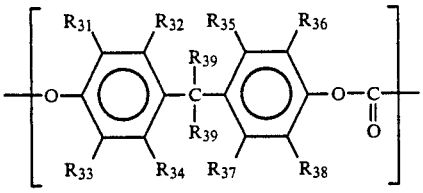

(c)

where $R_{31}$ to $R_{38}$ are respectively a hydrogen atom, a substituted or unsubstituted alkyl group, a substituted or unsubstituted alkoxy group, a substituted or unsubdstitued aryl group, or a halogen atom, and $R_{39}$ is a substituted or unsubstituted alkyl group, or a substituted or unsubstituted aryl group, $R_{39}$ having three or more carbons;

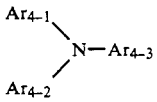

(4)

wherein $Ar_{4-1}$, $Ar_{4-2}$ and $Ar_{4-3}$ are respectively a substituted or unsubstituted aryl group, where the substituent is an alky group, an alkoxy group or a halogen atom;

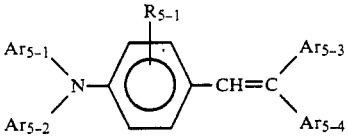

(5)

where $Ar_{5-1}$, $Ar_{5-2}$, and $Ar_{5-3}$ are respectively a substituted or unsubstituted aryl group; $Ar_{5-4}$ is a hydrogen atom or a substituted or unsubstituted aryl group; $Ar_{5-3}$ and $Ar_{5-4}$ may form a ring by linking together; $R_{5-1}$ is a hydrogen atom, a substituted or unsubstituted alkyl group, or a halogen atom.

The present invention further provides an electrophotographic apparatus, a device unit, and a facsimile machine which employ the above-specified electrophotographic photosensitive member.

DESCRIPTION OF THE PREFERRED EMBODIMENT

Figure 1:
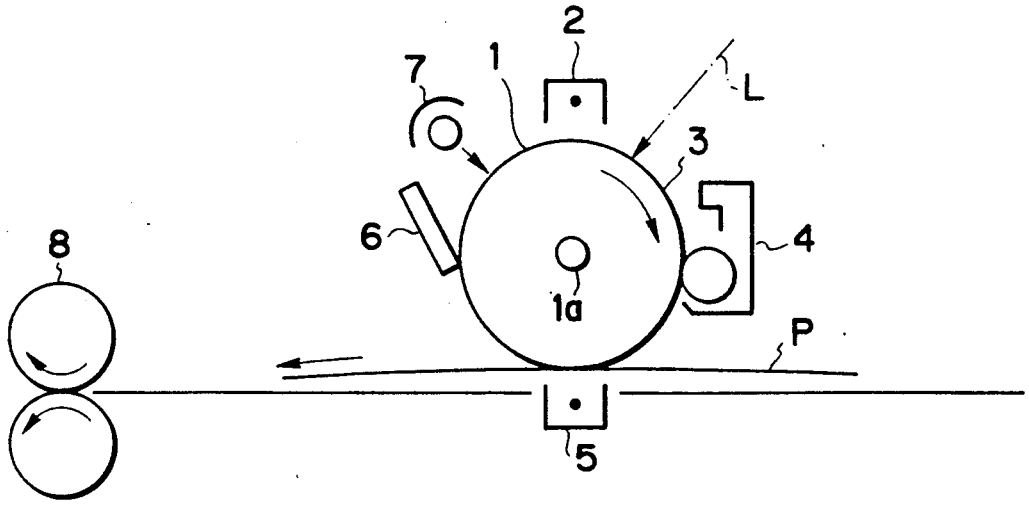
FIG. 1 shows schematically a constitution of an electrophotographic apparatus employing an electrophotographic photosensitive member of the present invention.

The electrophotographic photosensitive member of the the present invention has a photosensitive layer which contains at least one polycarbonate selected from the group consisting of polycarbonates (1) to (3) below; and a charge-transporting substance having the structure represented by the formula (4) or (5) and having an oxidation potential of not less than 0.6 eV:

(1) a copolymerized polycarbonate having the symmetric constitutional unit (a) below:

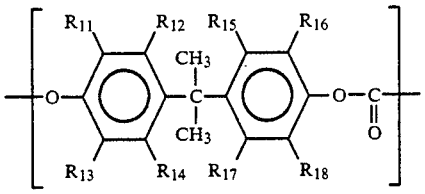

(a)

where $R_{11}$ to $R_{18}$ are respectively a hydrogen atom, a substituted or unsubstituted alkyl group, a substituted or unsubstituted alkoxy group, a substituted or unsubstituted aryl group, or a halogen atom, and the asymmetric constitutional unit (b) below:

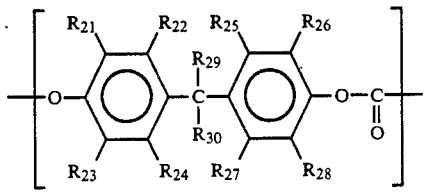

(b)

where $R_{21}$ to $R_{28}$ are respectively a hydrogen atom, a substituted or unsubstituted alkyl group, a substituted or unsubstituted alkoxy group, a substituted or unsubstituted aryl group, or a halogen atom, and $R_{29}$ and $R_{30}$ are respectively a hydrogen atom, a substituted or unsubstituted alkyl group, or a substituted or unsubstituted aryl group, or $R_{29}$ and $R_{30}$ may form a substituted or unsubstituted cycloalkylidene group by linking together;

(2) A copolymerized polycarbonate having two or more asymmetric constitutional units represented by the formula (b) above;

(3) a polycarbonate having a symmetric constitutional unit represented by the formula (c) below:

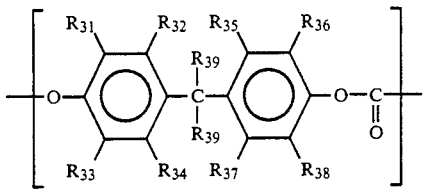

(c)

where $R_{31}$ to $R_{38}$ are respectively a hydrogen atom, a substituted or unsubstituted alkyl group, a substituted or unsubstituted alkoxy group, a substituted or unsubstituted aryl group, or a halogen atom, and $R_{39}$ is a substituted or unsubdstitued alkyl group, or a substituted or unsubstituted aryl group, $R_{39}$ having three or more carbons;

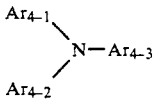

(4)

wherein $Ar_{4-1}$, $Ar_{4-2}$ and $Ar_{4-3}$ are respectively a substituted or unsubstituted aryl group, where the substituent is an alkyl group, an alkoxy group or a halogen atom;

(5)

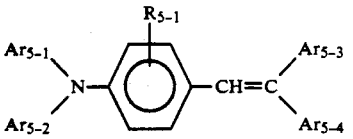

where $ArS_{5-1}$, $ArS_{5-2}$, and $ArS_{5-3}$are respectively a substituted or unsubstituted aryl group; $Ar_{5-4}$ is a hydrogen atom or a substituted or unsubstituted aryl group; $Ar_{5-3}$ and $Ar_{5-4}$ may form a ring by linking together; $R_{5-1}$ is a hydrogen atom, a substituted or unsubstituted alkyl group, or a halogen atom.

Of the groups $R_{11}$ to $R_{18}$, $R_{21}$ to $R_{28}$, and $R_{31}$ to $R_{38}$ in the above formulas, the alkyl group includes methyl, ethyl, and propyl; the alkoxy group includes methoxy, ethoxy, and propoxy; the aryl group includes phenyl, biphenyl, and naphthyl; and the halogen atom includes fluorine, chlorine, and bromine. Of the groups $R_{29}$ and $R_{30}$ the alkyl group includes methyl, ethyl, propyl, and butyl; the aryl group includes phenyl, biphenyl, and naphthyl; and the cycloalkylidene group includes cyclohexylidene and cyclododecylidene. Of the groups $R_{39}$ and $R_{40}$, the alkyl group includes propyl, butyl, and pentyl; and the aryl group includes phenyl, biphenyl, and naphthyl. The substituents which may be possessed by the above groups include the above-mentioned alkyl groups, aryl groups, or halogen atoms.

In the present invention, it is assumed that the asymmetric constitutional units and the symmetric constitutional units having a substituent of three or more carbons constituting the polycarbonate do not hinder the free rotation of the phenyl group and give the polycarbonate flexibility, thereby preventing effectively the occurrence of solvent cracks. Accordingly, the ratio of the asymmetric constitutional units in the polycarbonate is preferably not less than 25 mol. %, more preferably not less than 50 mol. % based on the total constitutional units of the polycarbonate.

The term "symmetric constitutional unit" in the present invention means a constitutional unit of a structure which is linearly symmetric relative to the main chain of bisphenol in the structural formula of a bisphenol capable of deriving the symmetric constitutional unit, and the term "asymmetric constitutional unit" means a constitutional unit which is not linearly symmetric.

The polycarbonate of the present invention may be synthesized from the bisphenols corresponding to the constitutional units by use of phosgene.

The specific examples of the bisphenols for deriving the preferred constitutional units in the present invention are shown below. The bisphenols useful in the present invention are not limited thereto.

(i) Bisphenols for deriving the asymmetric constitutional units:

(1)

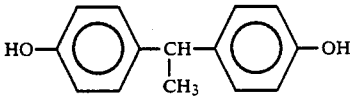

(2)

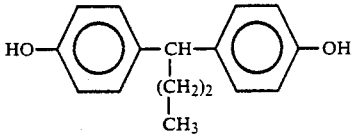

-continued (3)

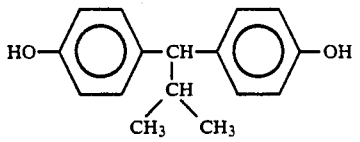

(4)

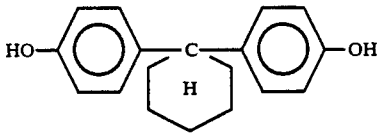

(5)

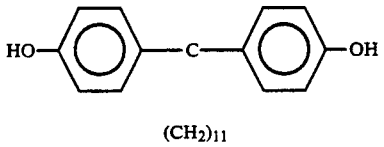

(6)

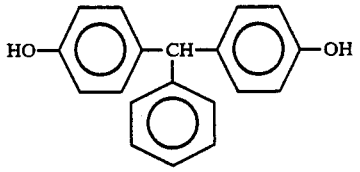

(7)

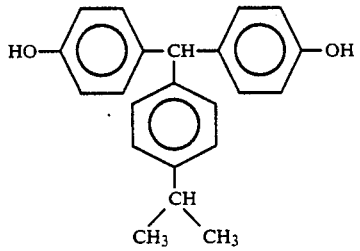

(8)

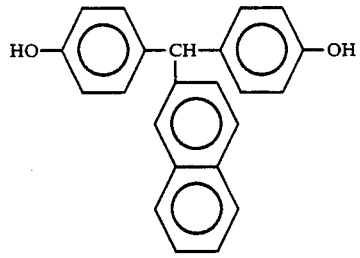

(9)

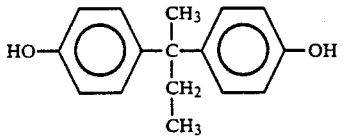

(10)

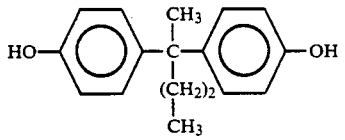

(11)

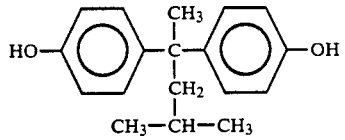

-continued
(12)
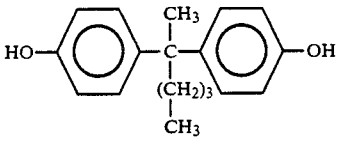
(13)
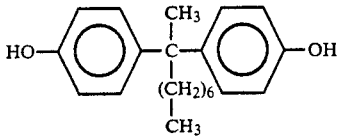
(14)
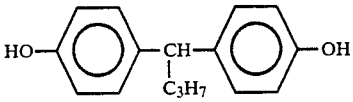
(15)
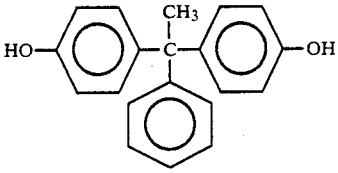
(16)
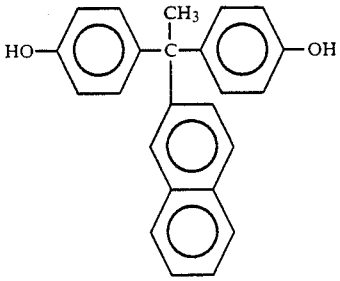
(17)
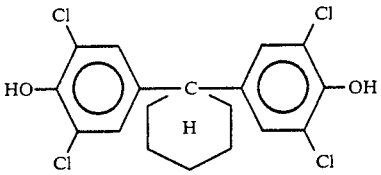
(18)
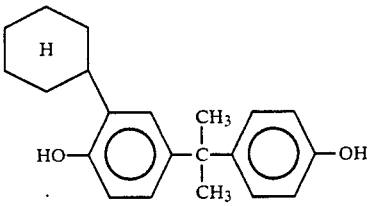
(19)
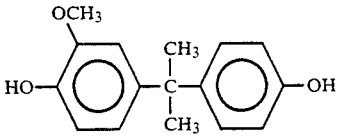
(20)
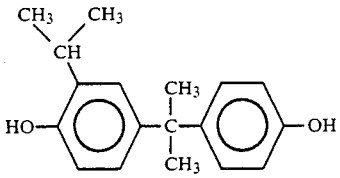
-continued
(21)
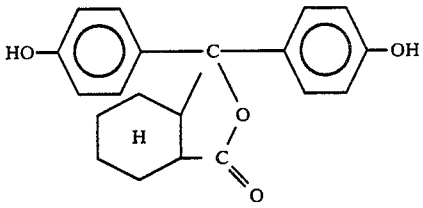
(22)
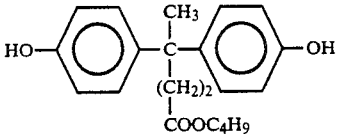
(23)
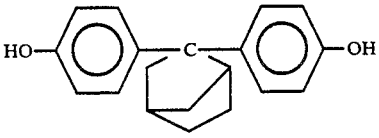
(24)
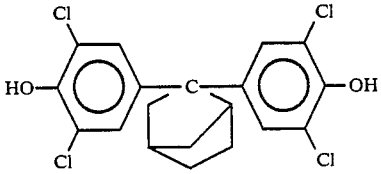
(25)
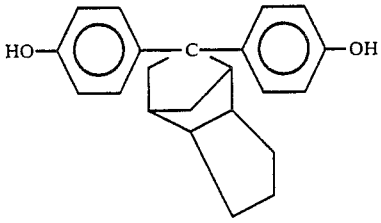
(26)
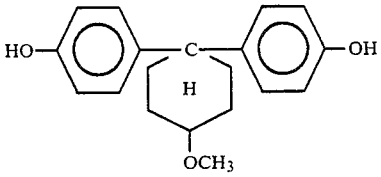
(27)
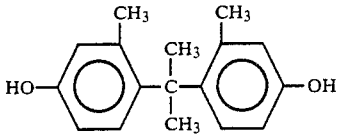
(28)
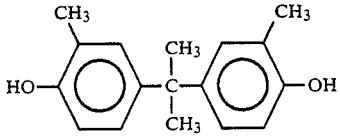
(29)
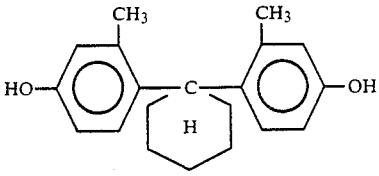

-continued

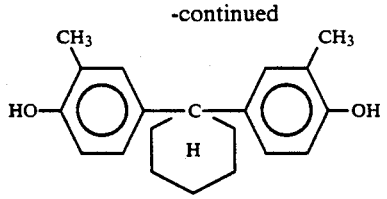

(30)

(ii) Bisphenols for deriving the symmetric constitutional units:

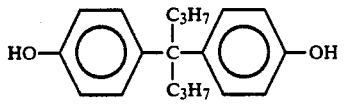

(31)

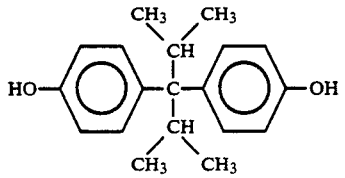

(32)

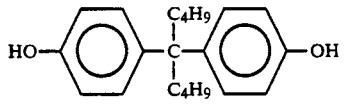

(33)

The polycarbonate of the present invention has preferably a molecular weight ranging from 1,000 to 150,000, more preferably from 5,000 to 100,000 in terms of viscosity-average molecular weight (Mv) in consideration of the hardness, or abrasion resistance and scratching resistance, and viscosity during production, or productivity of the polycarbonate.

In the present invention, the polycarbonates (1) and (2) are particularly preferred in consideration of high hardness.

In the present invention, an electrophotographic photosensitive member in which cracks are hardly formed can be obtained by simultaneous use of the charge-transporting substance represented by the above formula (4) or (5) and having an oxidation potential of not less than 0.6 eV with the polycarbonate.

In the formula (4), the aryl group for Ar $Ar_{4-2}$ and $Ar_{4-3}$ includes phenyl, biphenyl, naphthyl, anthryl, pyrenyl, fluorenyl and the like. The alkyl group as the substituent on the aryl group includes methyl, ethyl, propyl and the like; the alkoxy group as the substituent includes methoxy, ethoxy, propoxy and the like; and the halogen atom as the substituent includes fluorine, chlorine, bromine and the like.

In the formula (5), the aryl group for $Ar_{5-1}$, $Ar_{5-2}$, $Ar_{5-3}$ and $Ar_{5-4}$, includes phenyl, naphthyl and the like. The alkyl group and halogen atom for $R_{5-1}$ include the same ones as defined with respect to the formula (4). The substituents which may be possessed are the same ones as defined in connection with the formula (4).

The charge-transporting substance having the structure represented by the formula (4) is preferably the one of the formula (6) or (7) below:

Formula

-continued

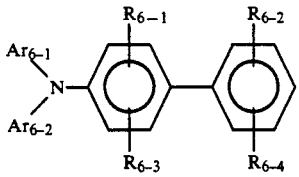

(6)

wherein $Ar_{6-1}$ and $Ar_{6-2}$ are respectively a substituted or unsubstituted aryl group, and $R_1$, $R_{6-2}$, $R_{6-3}$, and $R_{6-4}$ are respectively a hydrogen atom, a substituted or unsubstituted alkyl group, a substituted or unsubstituted alkoxy group, or a halogen atom;

Formula

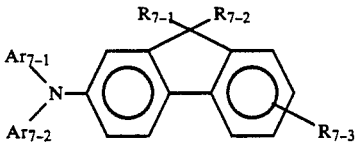

(7)

wherein $Ar_{7-1}$ and $Ar_{7-2}$ are respectively a substituted or unsubstituted aryl group, and $R_{7-1}$, and $R_{7-2}$ are respectively a hydrogen atom, and a substituted or unsubstituted alkyl group, $R_{7-3}$ is a hydrogen atom, a substituted or unsubstituted alkyl group, a substituted or unsubstituted alkoxy group or a halogen atom.

In the formulas (6) and (7), the aryl group for $Ar_{6-1}$, $Ar_{6-2}$, $Ar_{7-1}$ and $Ar_{7-2}$includes the same one as defined with respect to the formula (5). The alkyl group, alkoxy group and halogen atom for $R_{6-1}$, $R_{6-2}$, $R_{6-3}$, $R_{6-4}$ and $R_{7-3}$include the same ones as defined in connection with the formula (4). The alkyl group for $R_{7-1}$ and $R_{7-2}$includes the same one as defined with respect to the formula (4). The substituents which may be possessed includes the same as defined with respect to the formula (4).

The charge-transporting substance having the structure represented by the formula (5) is preferably the one of the formula (8):

Formula

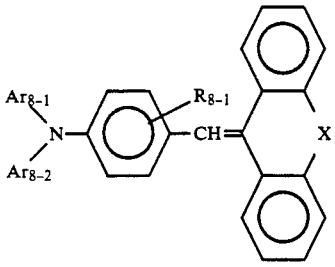

(8)

wherein $Ar_{8-1}$ and $Ar_{8-2}$are respectively a substituted or unsubstituted aryl group, $R_{8-1}$ is a hydrogen atom, a substituted or unsubstituted alkyl group, or a halogen atom, and X is the group of —CH=CH— or —$CH_2CH_2$—.

In the formula (8), the aryl group for $Ar_{8-1}$ and $Ar_{8-2}$, the alkyl group and halogen atom for $R_{8-1}$, and the substituent which may be possessed include the same ones as defined in connection with the formula (5).

Specific examples of the charge-transporting substance are shown below. However, the charge-transporting substance is not limited thereto.
| Exemplified compound No. | Oxidation potential (eV) |
|---|---|
| C-(1) 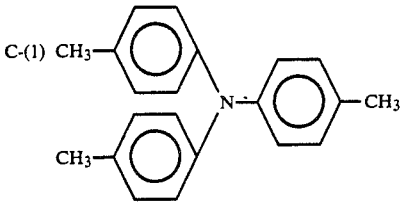 | 0.78 |
| C-(2) 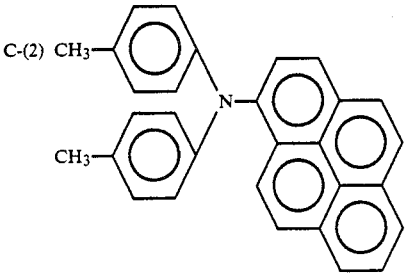 | 0.82 |
| C-(3) 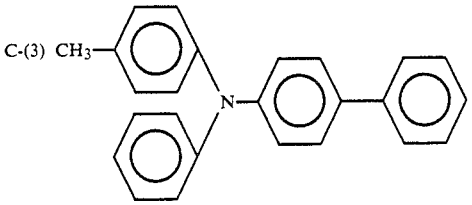 | 0.87 |
| C-(4) 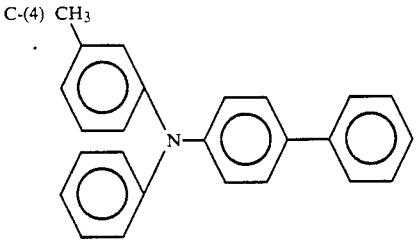 | 0.88 |
| C-(5) 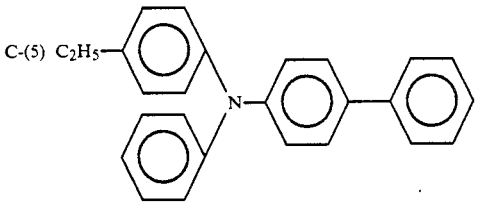 | 0.86 |
| C-(6) 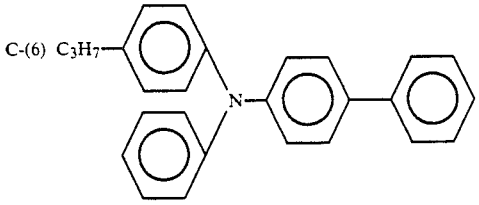 | 0.86 |

-continued
| Exemplified compound No. | Oxidation potential (eV) |
|---|---|
| C-(7) 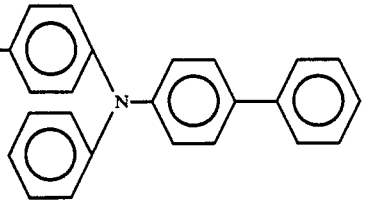 | 0.81 |
| C-(8) 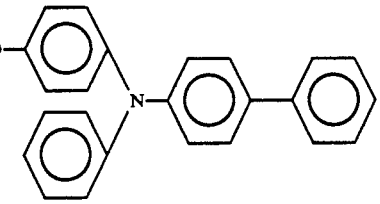 | 0.86 |
| C-(9) 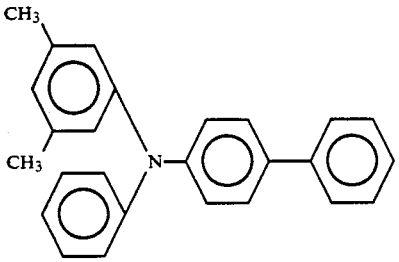 | 0.87 |
| C-(10) 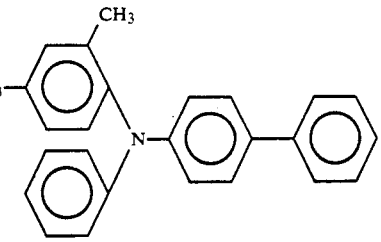 | 0.85 |
| C-(11) 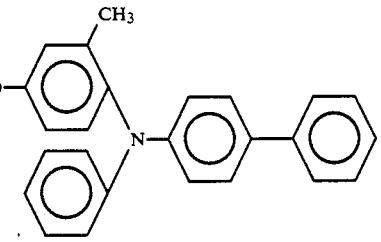 | 0.78 |
| C-(12) 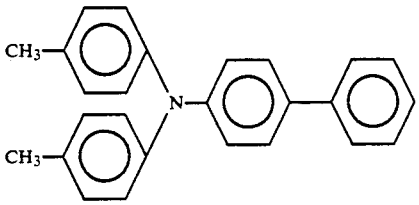 | 0.86 |

-continued
| Exemplified compound No. | Oxidation potential (eV) |
|---|---|
| C-(13) 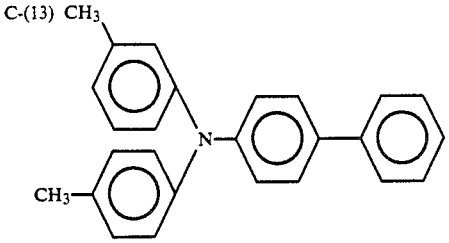 | 0.86 |
| C-(14) 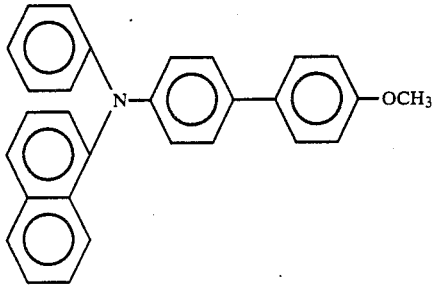 | 0.95 |
| C-(15) 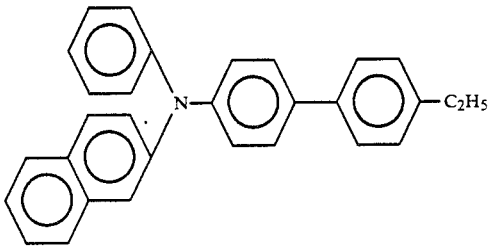 | 0.90 |
| C-(16) 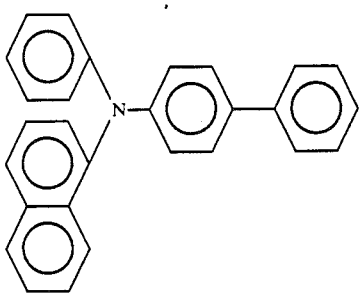 | 0.95 |
| C-(17) 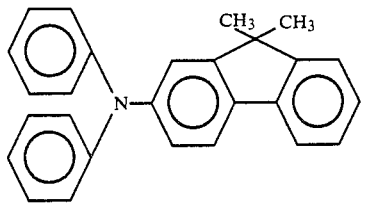 | 0.86 |
| C-(18) 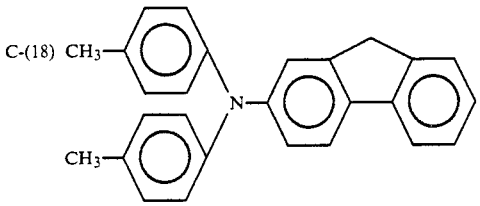 | 0.74 |

-continued
| Exemplified compound No. | Oxidation potential (eV) |
|---|---|
| C-(19) 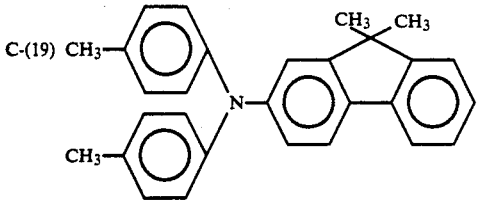 | 0.76 |
| C-(20) 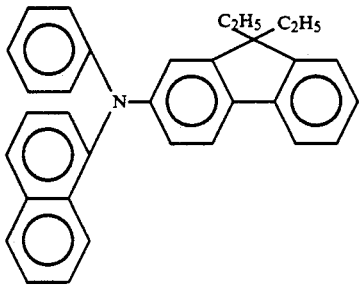 | 0.89 |
| C-(21) 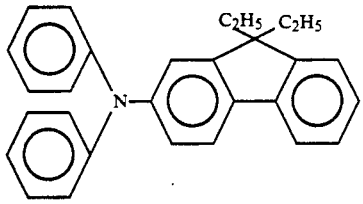 | 0.86 |
| C-(22) 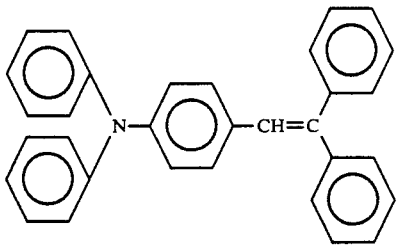 | 0.86 |
| C-(23) 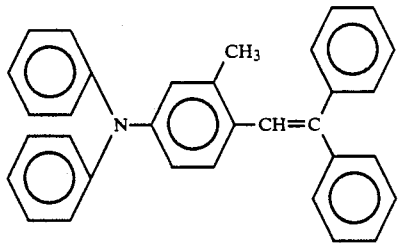 | 0.74 |
| C-(24) 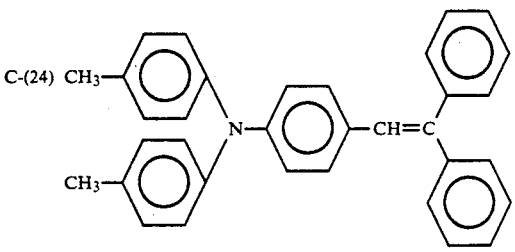 | 0.76 |

-continued

| Exemplified compound No. | Oxidation potential (eV) |
|---|---|
| C-(25) 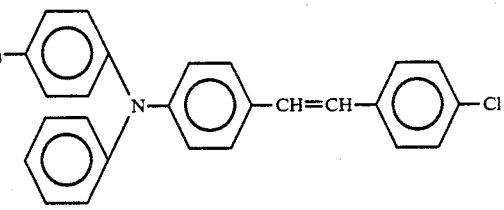 | 0.22 |
| C-(26) 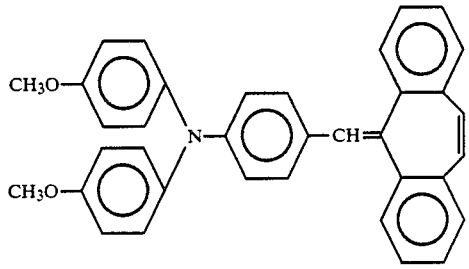 | 0.67 |
| C-(27) 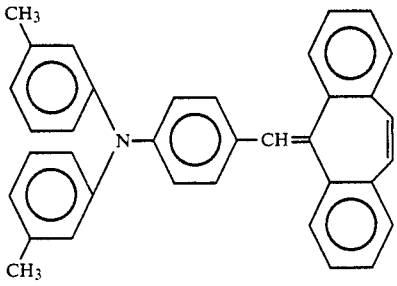 | 0.87 |
| C-(28) 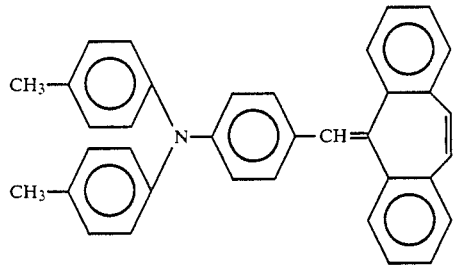 | 0.81 |
| C-(29) 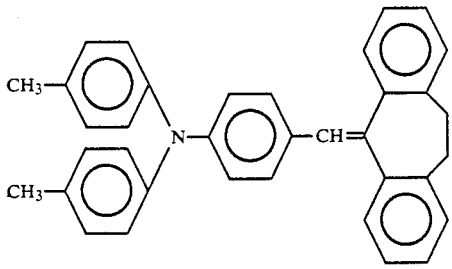 | 0.79 |

From among the above exemplified compounds for the charge-transporting substance, particularly preferred are C-(12), C-(16), C-(17), C-(19), C-(22), C-(24), C-(25), and C-(28).

The photosensitive layer of the electrophotographic photosensitive member of the present invention may be a single layer type which contains a charge-generating substance, a charge-transporting substance, and the polycarbonate in one and the same layer, or may be a lamination type which comprises a charge-transporting layer containing a charge-transporting substance and the polycarbonate, and a charge-generating layer containing a charge-generating substance. In the present invention, the latter is preferred in consideration of the sensitivity.

The charge-generating layer of the lamination type of photosensitive layer contains a charge-generating substance selected from the materials of inorganic charge-generating substances such as selenium, selenium-tellurium, and amorphous silicon; cationic dyes such as pyrylium dyes, thiapyrylium dyes, azulenium dyes, thiacyanine dyes, and quinone cyanine dyes; squarilium salt dyes; phthalocyanine pigments; polycyclic quinone pigments such as anthanthrone pigments, dibenzopyrenequinone pigments, and pyranthorone pigments; indigo pigments; quinacridone pigments; azo pigments and the like. The above charge-generating substance may be used singly or in combination of two or more thereof. The charge-generating layer may be formed as a vapor-deposition layer by use of a vapor deposition apparatus, or as a coating layer formed by applying and drying a coating liquid containing the charge-generating substance and the binder resin dissolved or dispersed in a suitable solvent. The binder resin is selected from a variety of insulating resins, including polyvinylbutyral, polyarylate (a polycondensate of bisphenol A and phthalic acid), polycarbonate, polyester, polyvinyl acetate, acrylic resins, polyacrylamide, polyamide, cellulose resins, urethane resins, epoxy resins, and polyvinyl alcohol. The binder resin further includes organic photoconductive resins such as poly-N-vinylcarbazole and polyvinylpyrene. The content of the binder resin in the charge-generating layer is preferably not higher than 80% by weight, more preferably not higher than 40% by weight based on the total weight of the charge-generating layer. The thickness of the charge-generating layer is preferably not more than 5 μm, more preferably within the range of from 0.01 to 1 μm.

The charge-transporting layer may be formed by applying and drying a solution of the charge-generating substance and the aforementioned polycarbonate in a suitable solvent. The ratio of the polycarbonate in the charge-transporting layer is preferably in the range of from 20 to 80%, more preferably from 30 to 60% by weight based on the total weight of the charge-transporting substance. The thickness of the charge-transporting layer is preferably in a range of from 5 to 40 μm, more preferably from 10 to 30 μm.

In the case where the photosensitive layer is of a single layer type, the photosensitive layer may be formed by applying and drying a coating liquid containing the charge-generating substance, charge-transporting substance, and the binder resin dispersed or dissolved in a suitable solvent. The thickness of the photosensitive layer is preferably in a range of from 5 to 40 μm, more preferably from 10 to 30 μm.

Further in the present invention, a subbing layer which has both a barrier function and an adhesive function is preferably provided between the electroconductive support and the photosensitive layer. The material for the subbing layer includes polyvinyl alcohol, polyethylene oxide, ethylcellulose, methylcellulose, casein, polyamide, glue, gelatin and the like. The material is dissolved in a suitable solvent, and applied and dried on the electroconductive support. The thickness thereof is preferably not more than 5 μm, more preferably in a range of from 0.2 to 3.0 μm.

Further, as a protection layer, a simple resin layer or a resin layer containing electroconductive particles or a charge-transporting substance may be provided on the photosensitive layer in order to protect the photosensitive layer from adverse mechanical and chemical influences from outside.

The above-mentioned various layers may be applied by dip coating, spray coating, beam coating, spinner coating, roller coating, Meyer bar coating, blade coating, or the like coating method.

The electroconductive support may be made of a metal such as aluminum, aluminum alloy, copper, zinc, stainless steel, vanadium, molybdenum, chromium, titanium, nickel, indium, gold, and platinum. The support may also be made of a plastic (e.g., polyethylene, polypropylene, polyvinyl chloride, polyethylene terephthalate, acrylic resin, etc.) coated with the above metal or alloy by vapor deposition; the plastic, metal, or alloy coated with an electroconductive particulate material (e.g., carbon black, particulate silver, etc.) dispersed in a binder resin; or a plastic or paper impregnated with an electroconductive particulate material.

The support may be in a drum shape, a sheet shape, a belt shape, or any other shape. The shape is selected to be most suitable for the electrophotographic apparatus employed.

The electrophotographic photosensitive member of the present invention is applicable to electrophotographic apparatuses generally such as copying machines, laser printers, LED printers, and liquid crystal shutter type printers, but it is also applicable widely to apparatuses for display, recording, light printing, engraving, facsimile, and so forth which utilize the electrophotography technique.

FIG. 1 illustrates schematically an example of the constitution of a transfer type electrophotographic apparatus employing the electrophotographic photosensitive member of the present invention.

In FIG. 1, a drum type photosensitive member 1 of the present invention is driven to rotate around the axis 1*a* in the arrow direction at a prescribed peripheral speed. The photosensitive member 1 is charged positively or negatively at the peripheral face uniformly during the rotation by an electrostatic charging means 2, and then exposed to image-exposure light L (e.g. slit exposure, laser beam-scanning exposure, etc.) at the exposure portion 3 with an image-exposure means (not shown in the drawing), whereby electrostatic latent images are sequentially formed on the peripheral surface in accordance with the exposed image.

The electrostatic latent image is developed with a toner by a developing means 4. The toner-developed images are sequentially transferred by a transfer means 5 onto a surface of a transfer-receiving material P which is fed between the photosensitive member 1 and the transfer means 5 synchronously with the rotation of the photosensitive member 1 from a transfer-receiving material feeder not shown in the drawing.

The transfer-receiving material P having received the transferred image is separated from the photosensitive member surface, and introduced to an image fixing means 8 for fixation of the image and sent out of the copying machine as a duplicate copy.

The surface of the photosensitive member 1, after the image transfer, is cleaned with a cleaning means 6 to remove any remaining non-transferred toner, and is treated for charge elimination with a pre-exposure means 7 for repeated use for image formation.

The generally employed charging means 2 for uniformly charging the photosensitive member 1 is a corona charging apparatus. The generally employed transfer means 5 is also a corona transferring means. In the electrophotographic apparatus, two or more of the constitutional elements of the above described photosensitive member, the developing means, the cleaning means, etc. may be integrated into one device unit, which may be made demountable from the main body of the apparatus. For example, at least one of the charging means, the developing means, and the cleaning means is combined with the photosensitive member 1 into one device unit which is demountable from the main body of the apparatus by aid of a guiding means such as a rail in the main body of the apparatus. An electrostatic charging means and/or a developing means may be combined with the aforementioned device unit.

In the case where the electrophotographic apparatus is used as a copying machine or a printer, the optical image exposure light L may be projected onto the photosensitive member as reflected light or transmitted light from an original copy, or otherwise the information read out by a sensor from an original may be signalized, and light is projected, onto a photosensitive member, by scanning with a laser beam, driving an LED array, or driving a liquid crystal shutter array according to the signal.

Figure 2:
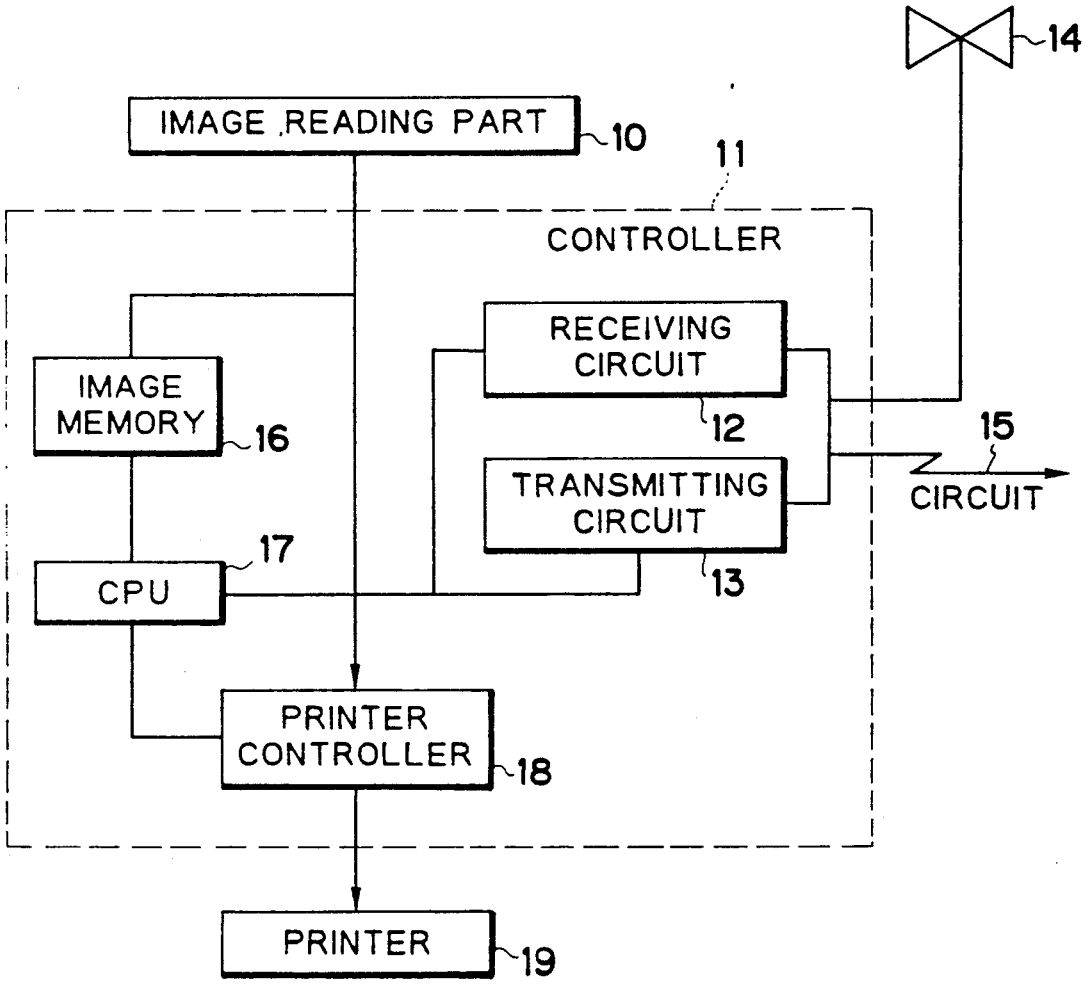
FIG. 2 shows an example of a block diagram of a facsimile system employing an electrophotographic photosensitive member of the present invention.

In the case where the electrophotographic apparatus is used as a printer of a facsimile machine, the optical image exposure light L is employed for printing the received data. FIG. 2 is a block diagram of an example of this case.

A controller 11 controls the image-reading part 10 and a printer 19. The entire of the controller 11 is controlled by a CPU 17. Readout data from the image reading part 10 is transmitted through a transmitting circuit 13 to the other communication station. Data received from the other communication station is transmitted through a receiving circuit 12 to a printer 19. The image data is stored in image memory 16. A printer controller 18 controls a printer 19. The numeral 14 denotes a telephone set.

The image received through a circuit 15, namely image information from a remote terminal connected through the circuit, is demodulated by the receiving circuit 12, treated for compounding of the image information in CPU 17, and successively stored in the image memory 16. When at least one page of image information has been stored in the image memory 16, the images are recorded in such a manner that the CPU 17 reads out the one page of image information, and sends out the compounded one page of information to the printer controller 18, which controls the printer 19 on receiving the one page of information from CPU 17 to record the image information.

During recording by the printer 19, the CPU 17 receives the subsequent page of information.

Images are received and recorded in the manner as described above.

The present invention is described in more detail by reference to Examples without limiting the invention in any way. In the Examples the term "parts" is based on weight.

EXAMPLE 1

Onto an aluminum cylinder of 30 mm diameter and 260 mm long, a paint composed of the materials given below was applied by dip coating, and the coated matter was cured by heating at 140° C. for 30 minutes to form an electroconductive layer of 18 μm thick.

| | |
|---|---|
| Electroconductive pigment: | |
| Titanium oxide coated with tin oxide | 10 parts |
| Resistance-controlling pigment: | |
| Titanium oxide | 10 parts |
| Binder resin: Phenol resin | 10 parts |
| Leveling agent: Silicone oil | 0.001 part |
| Solvent: Methanol/methylcellosolve = 1:1 (by weight) | 20 parts |

On this electroconductive layer, a solution of 3 parts of N-methoxymethylated nylon and 3 parts of copolymer nylon in 65 parts of methanol and 30 parts of n-butanol was applied by dip coating to form a subbing layer of 0.5 μm thick.

Separately, 3 parts of disazo pigment represented by the formula below:

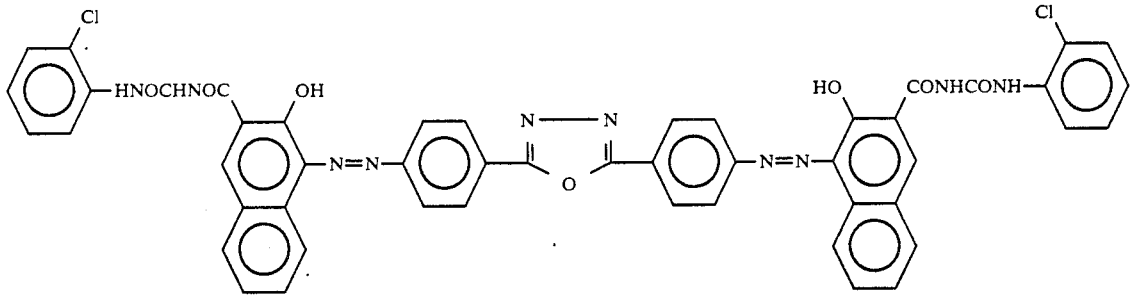

and 2 parts of polyvinylbenzal (benzalation degree: 80 %, weight-average molecular weight 11,000) were dispersed in 80 parts of cyclohexanone for 24 hours by means of a sand mill by using glass beads of 1 mm diameter. Then 115 parts of methyl ethyl ketone was added thereto to prepare a liquid dispersion for a charge-generating layer. This dispersion was applied onto the aforementioned subbing layer by dip coating to form a charge-generating layer of 0.2 μm thick.

10 parts of Exemplified compound C-(19) as the charge-transporting substance, and 10 parts of the copolymer having the structure of the Formula (I-1) below were dissolved in 50 parts of monochlorobenzene and 10 parts of dichloromethane.

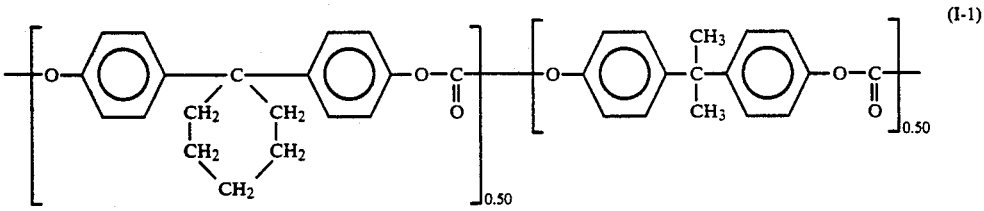

(I-1)

(Mv = 3.2 × $10^4$)

The resulting paint was applied onto the above-mentioned charge-generating layer by dip coating to form a charge-transporting layer of 20 μm thick. This charge-transporting substance had an oxidation potential of 0.76 eV. In the above formula, the attached numerals at the sides of the structural units show the molar fractions of copolymerization (in Formula (I-1), the "numerals" denotes 0. 50 and 0. 50, hereinafter the same).

The obtained photosensitive member was tested for solvent crack resistance and sensitivity. The solvent crack resistance was evaluated by staining the photosensitive member with finger fat and lubricating oil (PS-158, made by Sanwa Yuka), observing the stained portion 24 hours later by microscope, and observing visually the formed images. The sensitivity was measured by mounting the photosensitive member on a copying machine (FC-2, made by Canon K.K. ). The results are shown in Table 1.

COMPARATIVE EXAMPLE 1

A photosensitive member was prepared and evaluated in the same manner as in Example 1 except that polycarbonate Z (weight-average molecular weight: 2.2×$10^4$) was used as the binder resin of the charge-transporting layer. The results are shown in Table 1.

EXAMPLE 2

A photosensitive member was prepared and evaluated in the same manner as in Example 1 except that the copolymer having the structure of Formula (II-1) below was used as the binder resin of the charge-transporting layer.

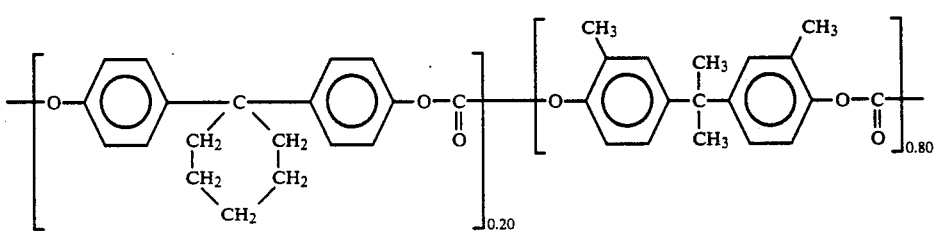

(II-1)

(Mv = 4.0 × $10^4$)

The result are shown in Table 1.

EXAMPLE 3

A photosensitive member was prepared and evaluated in the same manner as in Example 1 except that Exemplified compound C-(26) was used as the charge-transporting substance. The results are shown in Table 1.

EXAMPLE 4

A photosensitive member was prepared and evaluated in the same manner as in Example 1 except that Exemplified compound C-(17) was used as the charge-transporting substance and the copolymer having the structure of the formula below was used as the binder resin of the charge-transporting layer.

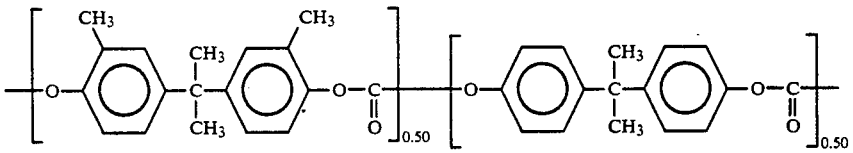

(I-2)

(Mv = 3.0 × $10^4$)

The results are shown in Table 1.

EXAMPLES 5 AND 6

A photosensitive member was prepared and evaluated in the same manner as in Example 1 except that Exemplified compound C-(29) or C-(3) as the charge-transporting substance. The results are shown in Table 1.

EXAMPLE 7

The layers to the subbing layer were formed in the same manner as in Example 1.

Separately, 3 parts of disazo pigment represented by the formula below:

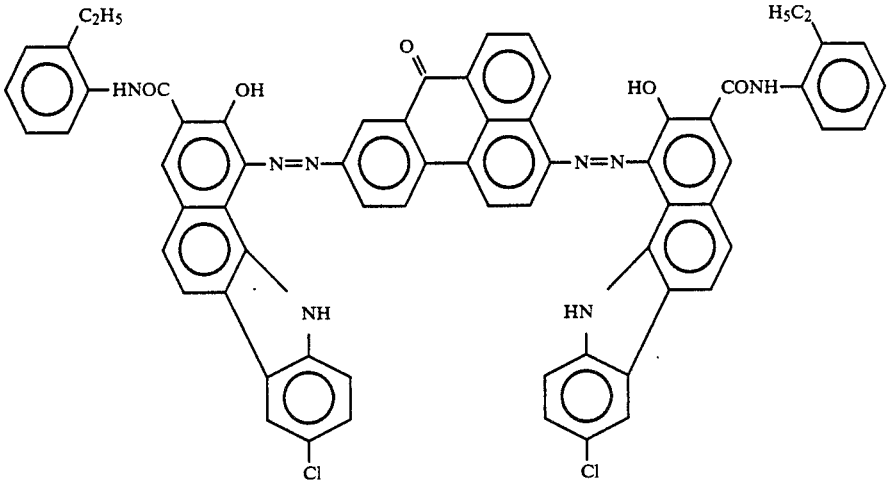

and 1.5 parts of polyvinylbutyral resin were dispersed in 80 parts of cyclohexanone for 40 hours by means of a sand mill by using glass beads of 1 mm diameter. Thereto, 100 parts of tetrahydrofuran was added to prepare a liquid dispersion for a charge-generating layer. This dispersion was applied onto the aforementioned subbing layer by dip coating to form a charge-generating layer of 0.2 μm thick.

Then 10 parts of Exemplified compound C-(1) as the charge-transporting substance, and 10 parts of the copolymer having the structure of Formula (I-3) below were dissolved in 50 parts of monochlorobenzene and 10 parts of dichloromethane.

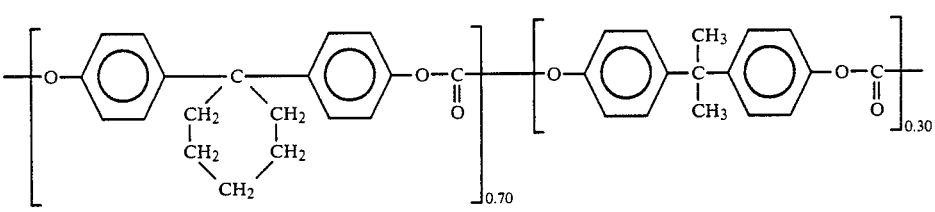

(Mv = 3.0 × 10⁴)

The resulting paint was applied onto the above-mentioned charge-generating layer by dip coating to form a charge-transporting layer of 20 μm thick.

The photosensitive member thus obtained was evaluated in the same manner as in Example 1 except that the sensitivity was measured by mounting the photosensitive member on a laser printer (LBP-SX, made by Canon K.K. ).

The results are shown in Table 1.

EXAMPLE 8

A photosensitive member was prepared and evaluated in the same manner as in Example 7 except that Exemplified compound C-(26) was used as the charge-transporting substance. The results are shown in Table 1.

COMPARATIVE EXAMPLE 2

A photosensitive member was prepared and evaluated in the same manner as in Example 1 except that the compound represented by the formula below (oxidation potential: 0.53 eV) was used as the charge-transporting substance.

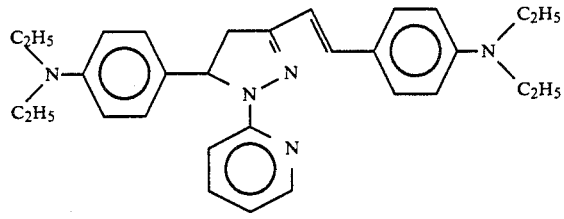

The results are shown in Table 1.

EXAMPLE 9

The layers to the subbing layer were formed in the same manner as in Example 1.

Separately, 3 parts of disazo pigment represented by the formula below:

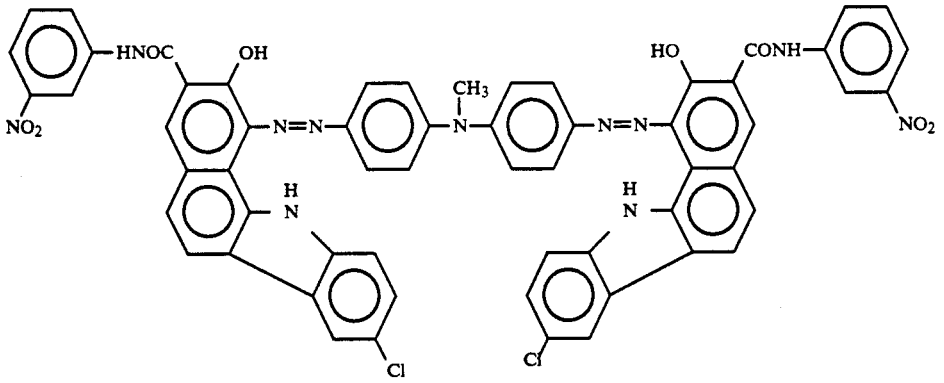

and 1.5 parts of polyvinylbutyral resin were dispersed in 80 parts of cyclohexanone for 40 hours by means of a sand mill by using glass beads of 1 mm diameter. Thereto, 100 parts of tetrahydrofuran was added to prepare a liquid dispersion for a charge-generating layer. This dispersion was applied onto the aforementioned subbing layer by dip coating to form a charge-generating layer of 0.2 μm thick.

10 parts of the charge-transporting substance employed in Example 1, and 10 parts of the copolymer having the structure of Formula (III-1) below were dissolved in 50 parts of monochlorobenzene and 10 parts of dichloromethane.

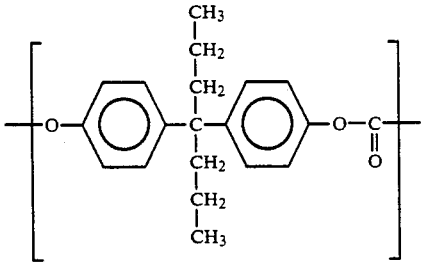

(III-1)

(Mv = 3.0 × $10^4$)

The resulting paint was applied onto the above-mentioned charge-generating layer by dip coating to form a charge-transporting layer of 20 μm thick.

The photosensitive member thus obtained was evaluated for solvent crack resistance and sensitivity in the same manner as in Example 7.

The results are shown in Table 2.

EXAMPLE 10

A photosensitive member was prepared and evaluated in the same manner as in Example 9 except that Exemplified compound C-(26) was used as the charge-transporting substance. The results are shown in Table 2.

COMPARATIVE EXAMPLE 3

A photosensitive member was prepared and evaluated in the same manner as in Example 9 except that polycarbonate Z (weight-average molecular weight: $2.2 \times 10^4$) was used as the binder resin of the charge-transporting layer. The results are shown in Table 2.

COMPARATIVE EXAMPLE 4

A photosensitive member was prepared and evaluated in the same manner as in Example 9 except that the charge-transporting substance was the one used in Comparative example 2. The results are shown in Table 2.

COMPARATIVE EXAMPLE 5

A photosensitive member was prepared and evaluated in the same manner as in Example 1 except that the compound represented by the formula below (oxidation potential: 0.76 eV) was used as the charge-transporting substance.

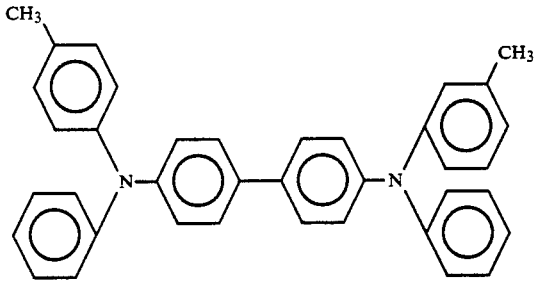

The results are shown in Table 3.

COMPARATIVE EXAMPLE 6

A photosensitive member was prepared and evaluated in the same manner as in Example 1 except that the compound represented by the formula below (oxidation potential: 0.48 eV) was used as the charge-transporting substance.

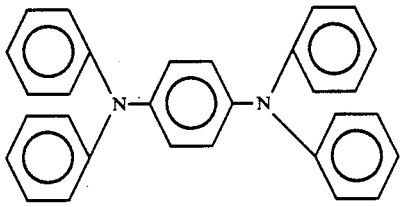

The results are shown in Table 3.

TABLE 1

| Photo-sensitive member | Polycarbonate Structural formula No. | Charge-transporting substance Structural formula No. | Charge-transporting substance Oxidation potential | Solvent-crack resistance characteristics Finger fat | Solvent-crack resistance characteristics Lubricating oil | Sensitivity |
|---|---|---|---|---|---|---|
| Example | | | | | | |
| 1 | I-1 | C-(19) | 0.76 | ◎ | ◎ | 3.7 lux · sec |
| 2 | II-1 | C-(19) | 0.76 | ○ | ○ | 3.8 lux · sec |
| 3 | I-1 | C-(26) | 0.67 | ◎ | ◎ | 3.7 lux · sec |
| 4 | I-2 | C-(17) | 0.86 | ◎ | ◎ | 3.7 lux · sec |
| 5 | I-2 | C-(29) | 0.79 | ◎ | ◎ | 3.9 lux · sec |
| 6 | I-2 | C-(3) | 0.87 | ◎ | ○ | 3.9 lux · sec |
| 7 | I-3 | C-(1) | 0.78 | ◎ | ◎ | 2.1 $\mu J/cm^2$ |
| 8 | I-3 | C-(26) | 0.67 | ◎ | ◎ | 2.2 $\mu J/cm^2$ |
| Comparative example | | | | | | |
| 1 | Polycarbonate Z | C-(19) | 0.76 | X | XX | 3.5 lux · sec |
| 2 | I-1 | — | 0.53 | X | X | 6.0 lux · sec |

Evaluation symbols for solvent crack resistance characteristics:
◎: No crack was observed on the photosensitive member.
○: A few cracks were observed on the photosensitive member, but the image was not affected.
X: Cracks were observed on the photosensitive member and the image was impaired.
XX: Cracks were observed on the photosensitive member, the image was impaired, and the area of crack formation was larger for the oil-stained area.

TABLE 2

| Photo-sensitive member | Polycarbonate Structural formula No. | Charge-transporting substance Structural formula No. | Charge-transporting substance Oxidation potential | Solvent-crack resistance characteristics Finger fat | Solvent-crack resistance characteristics Lubricating oil | Sensitivity |
|---|---|---|---|---|---|---|
| Example | | | | | | |
| 9 | III-1 | C-(19) | 0.76 | ◎ | ◎ | 2.8 $\mu J/cm^2$ |
| 10 | III-1 | C-(26) | 0.67 | ◎ | ◎ | 3.0 $\mu J/cm^2$ |
| Comparative example | | | | | | |
| 3 | Polycarbonate Z | C-(19) | 0.76 | X | XX | 3.6 $\mu J/cm^2$ |
| 4 | III-1 | — | 0.53 | X | X | 7.0 $\mu J/cm^2$ |

Evaluation symbols for solvent crack resistance characteristics:
◎: No crack was observed on the photosensitive member.
○: A few cracks were observed on the photosensitive member, but the image was not affected.
X: Cracks were observed on the photosensitive member and the image was impaired.
XX: Cracks were observed on the photosensitive member, the image was impaired, and the area of crack formation was larger for the oil-stained area.

TABLE 3

| Photo-sensitive member | Polycarbonate Structural formula No. | Charge-transporting substance Structural formula No. | Charge-transporting substance Oxidation potential | Solvent-crack resistance characteristics Finger fat | Solvent-crack resistance characteristics Lubricating oil | Sensitivity |
|---|---|---|---|---|---|---|
| Comparative example | | | | | | |
| 5 | I-1 | — | 0.72 | X | X | 3.9 lux · sec |
| 6 | I-1 | — | 0.48 | X | X | 4.3 lux · sec |

Evaluation symbols for solvent crack resistance characteristics:
◎: No crack was observed on the photosensitive member.
○: A few cracks were observed on the photosensitive member, but the image was not affected.
X: Cracks were observed on the photosensitive member and the image was impaired.
XX: Cracks were observed on the photosensitive member, the image was impaired, and the area of crack formation was larger for the oil-stained area.

What is claimed is:

1. An electrophotographic photosensitive member comprising an electroconductive support and a photosensitive layer formed thereon, said photosensitive layer containing at least one polycarbonate selected from the group consisting of polycarbonates (1) to (3)below; and a charge-transporting substance having the structure represented by the formula (4)or (5) and having an oxidation potential of not less than 0.6 eV, (1) a copolymerized polycarbonate having the symmetric constitutional unit (a) below:

(a)

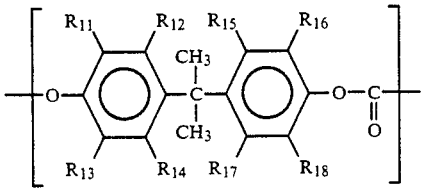

where $R_{11}$ to $R_{18}$ are respectively a hydrogen atom, a substituted or unsubstituted alkyl group, a substituted or unsubstituted alkoxy group, a substituted or unsubstituted aryl group, or a halogen atom, and the asymmetric constitutional unit (b) below:

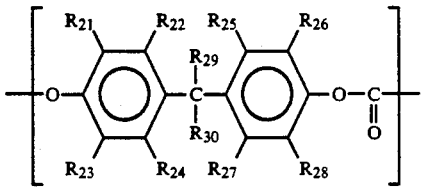

(b)

where $R_{21}$ to $R_{28}$ are respectively a hydrogen atom, a substituted or unsubstituted alkyl group, a substituted or unsubstituted alkoxy group, a substituted or unsubstituted aryl group, or a halogen atom, and $R_{29}$ and $R_{30}$ are respectively a hydrogen atom, a substituted or unsubstituted alkyl group, or a substituted or unsubstituted aryl group, or $R_{29}$ and $R_{30}$ may form a substituted or unsubstituted cycloalkylidene group by linking together;

(2) a copolymerized polycarbonate having two or more asymmetric constitutional units represented by the formula (b) above;

(3) a polycarbonate having a symmetric constitutional unit represented by the formula (c) below:

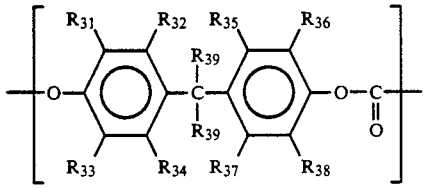

(c)

where $R_{31}$ to $R_{38}$ are respectively a hydrogen atom, a substituted or unsubstituted alkyl group, a substituted or unsubstituted alkoxy group, a substituted or unsubstituted aryl group, or a halogen atom, and $R_{39}$ is a substituted or unsubstituted alkyl group, or a substituted or unsubstituted aryl group, $R_{39}$ having three or more carbons;

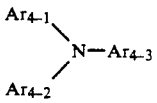

(4)

wherein $Ar_{4-1}$, $Ar_{4-2}$ and $Ar_{4-3}$ are respectively a substituted or unsubstituted aryl group, where the substituent is an alkyl group, an alkoxy group or a halogen atom;

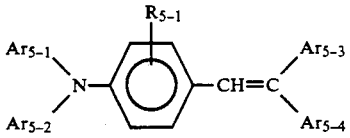

(5)

where $Ar_{5-1}$, $Ar_{5-2}$, and $Ar_{5-3}$ are respectively a substituted or unsubstituted aryl group; $Ar_{5-4}$ is a hydrogen atom or a substituted or unsubstituted aryl group; $Ar_{5-3}$ and $Ar_{5-4}$ may form a ring by linking together; $R_{5-1}$ is a hydrogen atom, a substituted or unsubstituted alkyl group, or a halogen atom.

2. An electrophotographic photosensitive member according to claim 1, wherein the polycarbonate (1) is employed.

3. An electrophotographic photosensitive member according to claim 1, wherein the polycarbonate (2) is employed.

4. An electrophotographic photosensitive member according to claim 1, wherein the polycarbonate (3) is employed.

5. An electrophotographic photosensitive member according to claim 2, wherein $R_{29}$ and $R_{30}$ in Formula (b) form cyclohexylidene by linking together.

6. An electrophotographic photosensitive member according to claim 5, wherein $R_{11}$ to $R_{18}$ in Formula (a) and $R_{21}$ to $R_{28}$ in Formula (b) are respectively a hydrogen atom.

7. An electrophotographic photosensitive member according to claim 1, wherein the charge-transporting substance has the structure represented by Formula (4).

8. An electrophotographic photosensitive member according to claim 1, wherein the charge-transporting substance has the structure represented by Formula (5).

9. An electrophotographic photosensitive member according to claim 7, wherein the charge-transporting substance has the structure represented by Formula (6) below:

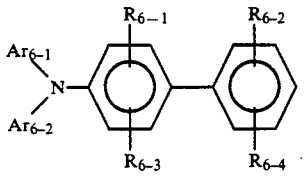

(6)

wherein $Ar_{6-1}$ and $Ar_{6-2}$ are respectively a substituted or unsubstituted aryl group, and $R_{6-1}$, $R_{6-2}$, $R_{6-3}$, and $R_{6-4}$ are respectively a hydrogen atom, a substituted or unsubstituted alkyl group, a substituted or unsubstituted alkoxy group, or a halogen atom.

10. An electrophotographic photosensitive member according to claim 7, wherein the charge transporting substance has the structure represented by Formula (7) below:

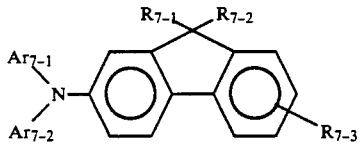

(7)

wherein $Ar_{7-1}$ and $Ar_{7-2}$ are respectively a substituted or unsubstituted aryl group, and $R_{7-1}$, and $R_{7-2}$ are respectively a hydrogen atom, or a substituted or unsubstituted alkyl group, $R_{7-3}$ is a hydrogen atom, a substituted or unsubstituted alkyl group, a substituted or unsubstituted alkoxy group or a halogen atom.

11. An electrophotographic photosensitive member according to claim 8, wherein the charge-transporting substance has the structure represented by Formula (8) below:

(8)

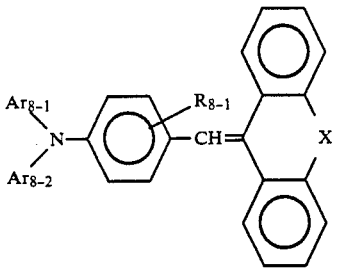

wherein $Ar_{8-1}$ and $Ar_{8-2}$ are respectively a substituted or unsubstituted aryl group, $R_{8-1}$ is a hydrogen atom, a substituted or unsubstituted alkyl group, or a halogen atom, and X is the group of —CH=CH— or —$CH_2CH_2$—.

12. An electrophotographic photosensitive member according to claim 1, wherein the photosensitive layer comprises a charge-generating layer and a charge-transporting layer.

13. An electrophotographic photosensitive member according to claim 12, wherein the electrophotographic photosensitive member has an electroconductive support, the charge-generating layer, and the charge-transporting layer in the named order.

14. An electrophotographic photosensitive member according to claim 12, wherein the electrophotographic photosensitive member has an electroconductive support, the charge-transporting layer, and the charge-generating layer in the named order.

15. An electrophotographic photosensitive member according to claim 1, wherein the photosensitive layer is a single layer.

16. An electrophotographic photosensitive member according to claim 1, wherein the electrophotographic photosensitive member has a subbing layer between the electroconductive support and the photosensitive layer.

17. An electrophotographic photosensitive member according to claim 1, wherein the electrophotographic photosensitive member has a protective layer on the photosensitive layer.

18. An electrophotographic apparatus comprising an electrophotographic photosensitive member, an image-forming means for forming an electrostatic latent image, a developing means for developing the formed latent image, and a transferring means for transferring a developed image to an image-receiving material;

said electrophotographic photosensitive member comprising an electroconductive support and a photosensitive layer formed thereon, the photosensitive layer containing at least one polycarbonate selected from the group consisting of polycarbonates (1) to (3) below; and a charge-transporting substance having the structure represented by the formula (4) or (5)and having an oxidation potential of not less than 0.6 eV, (1) a copolymerized polycarbonate having the symmetric constitutional unit (a) below:

(a)

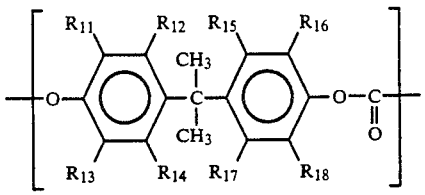

where $R_{11}$ to $R_{18}$ are respectively a hydrogen atom, a substituted or unsubstituted alkyl group, a substituted or unsubstituted alkoxy group, a substituted or unsubstituted aryl group, or a halogen atom, and the asymmetric constitutional unit (b) below:

(b)

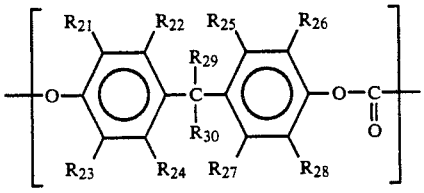

where $R_{21}$ to $R_{28}$ are respectively a hydrogen atom, a substituted or unsubstituted alkyl group, a substituted or unsubstituted alkoxy group, a substituted or unsubstituted aryl group, or a halogen atom, and $R_{29}$ and $R_{30}$ are respectively a hydrogen atom, a substituted or unsubstituted alkyl group, or a substituted or unsubstituted aryl group, or $R_{29}$ and $R_{30}$ may form a substituted or unsubstituted cycloalkylidene group by linking together;

(2) a copolymerized polycarbonate having two or more asymmetric constitutional units represented by the formula (b) above;

(3) a polycarbonate having a symmetric constitutional unit represented by the formula (c) below:

(c)

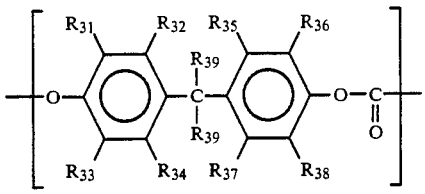

where $R_{31}$ to $R_{38}$ are respectively a hydrogen atom, a substituted or unsubstituted alkyl group, a substituted or unsubstituted alkoxy group, a substituted or unsubstituted aryl group, or a halogen atom, and $R_{39}$ is a substituted or unsubstituted alkyl group, or a substituted or unsubstituted aryl group, $R_{39}$ having three or more carbons;

(4)

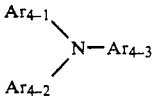

wherein $Ar_{4-1}$, $Ar_{4-2}$ and $Ar_{4-3}$are respectively a substituted or unsubstituted aryl group, where the substituent is an alkyl group, an alkoxy group or a halogen atom;

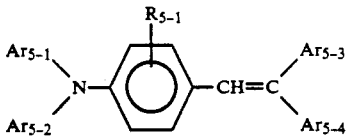

(5)

where $Ar_{5-1}$, $Ar_{5-2}$, and $Ar_{5-3}$ are respectively a substituted or unsubstituted aryl group; $Ar_{5-4}$ is a hydrogen atom or a substituted or unsubstituted aryl group; $Ar_{5-3}$ and $Ar_{5-4}$ may form a ring by linking together; $R_{5-1}$ is a hydrogen atom, a substituted or unsubstituted alkyl group, or a halogen atom.

19. A device unit comprising an electrophotographic photosensitive member, and at least one means selected from the group of a charging means, a developing means, and a cleaning means; said electrophotographic photosensitive member comprising an electroconductive support and a photosensitive layer formed thereon, the photosensitive layer containing at least one polycarbonate selected from the group consisting of polycarbonates (1) to (3)below; and a charge-transporting substance having the structure represented by the formula (4) or (5) and having an oxidation potential of not less than 0.6 eV, (1) a copolymerized polycarbonate having the symmetric constitutional unit (a) below:

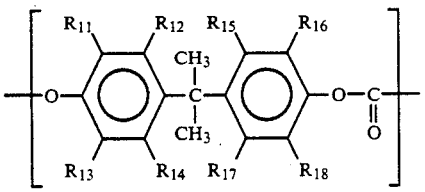

(a)

where $R_{11}$ to $R_{18}$ are respectively a hydrogen atom, a substituted or unsubstituted alkyl group, a substituted or unsubstituted alkoxy group, a substituted or unsubstituted aryl group, or a halogen atom, and the asymmetric constitutional unit (b) below:

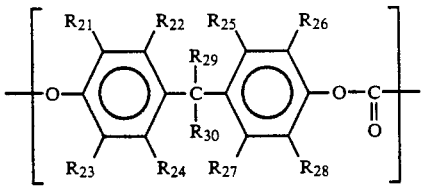

(b)

where $R_{21}$ to $R_{28}$ are respectively a hydrogen atom, a substituted or unsubstituted alkyl group, a substituted or unsubstituted alkoxy group, a substituted or unsubstituted aryl group, or a halogen atom, and $R_{29}$ and $R_{30}$ are respectively a hydrogen atom, a substituted or unsubstituted alkyl group, or a substituted or unsubstituted aryl group, or $R_{29}$ and $R_{30}$ may form a substituted or unsubstituted cycloalkylidene group by linking together;

(2) a copolymerized polycarbonate having two or more asymmetric constitutional units represented by the formula (b) above;

(3) a polycarbonate having a symmetric constitutional unit represented by the formula (c) below:

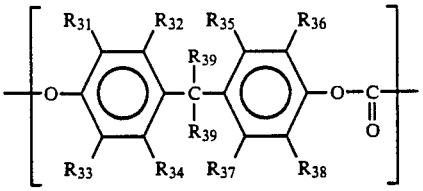

(c)

where $R_{31}$ to $R_{38}$ are respectively a hydrogen atom, a substituted or unsubstituted alkyl group, a substituted or unsubstituted alkoxy group, a substituted or unsubstituted aryl group, or a halogen atom, and $R_{39}$ is a substituted or unsubstituted alkyl group, or a substituted or unsubstituted aryl group, $R_{39}$ having three or more carbons;

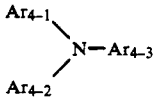

(4)

wherein $Ar_{4-1}$, $Ar_{4-2}$ and $Ar_{4-3}$ are respectively a substituted or unsubstituted aryl group, where the substituent is an alkyl group, an alkoxy group or a halogen atom;

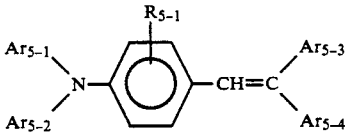

(5)

where $Ar_{5-1}$, $Ar_{5-2}$, and $Ar_{5-3}$ are respectively a substituted or unsubstituted aryl group; $Ar_{5-4}$ is a hydrogen atom or a substituted or unsubstituted aryl group; $Ar_{5-3}$ and $Ar_{5-4}$ may form a ring by linking together; $R_{5-1}$ is a hydrogen atom, a substituted or unsubstituted alkyl group, or a halogen a tom; and said unit holding integrally the electrophotographic photosensitive member and at least one means selected from the charging means, the developing means, and the cleaning means, and being demountable from the main body of an electrophotographic apparatus.

20. A facsimile machine comprising an electrophotographic apparatus and an information-receiving means for receiving image information from a remote terminal;

said electrophotographic apparatus comprising an electrophotographic photosensitive member; and said electrophotographic photosensitive member, comprising an electroconductive support and a photosensitive layer formed thereon, the photosensitive layer containing at least one polycarbonate selected from the group consisting of polycarbonates (1) to (3)below; and a charge-transporting substance having the structure represented by the formula (4)or (5) and having an oxidation potential of not less than 0.6 eV, (1) a copolymerized polycarbonate having the symmetric constitutional unit (a) below:

(a)

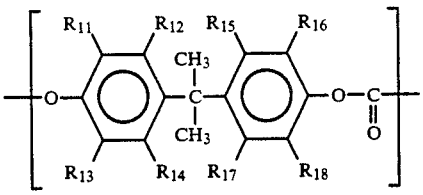

where $R_{11}$ to $R_{18}$ are respectively a hydrogen atom, a substituted or unsubstituted alkyl group, a substituted or unsubstituted alkoxy group, a substituted or unsubstituted aryl group, or a halogen atom, and the asymmetric constitutional unit (b) below:

(b)

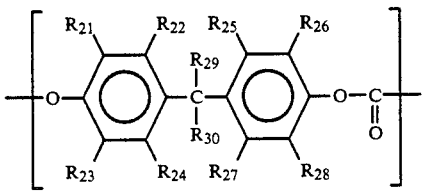

where $R_{21}$ to $R_{28}$ are respectively a hydrogen atom, a substituted or unsubstituted alkyl group, a substituted or unsubstituted alkoxy group, a substituted or unsubstituted aryl group, or a halogen atom, and $R_{29}$ and $R_{30}$ are respectively a hydrogen atom, a substituted or unsubstituted alkyl group, or a substituted or unsubstituted aryl group, or $R_{29}$ and $R_{30}$ may form a substituted or unsubstituted cycloalkylidene group by linking together;

(2) a copolymerized polycarbonate having two or more asymmetric constitutional units represented by the formula (b) above;

(3) a polycarbonate having a symmetric constitutional unit represented by the formula (c) below:

(c)

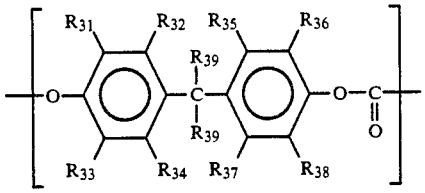

where $R_{31}$ to $R_{38}$ are respectively a hydrogen atom, a substituted or unsubstituted alkyl group, a substituted or unsubstituted alkoxy group, a substituted or unsubstituted aryl group, or a halogen atom, and $R_{39}$ is a substituted or unsubstituted alkyl group, or a substituted or unsubstituted aryl group, $R_{39}$ having three or more carbons;

(4)

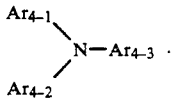

wherein $Ar_{4-1}$, $Ar_{4-2}$ and $Ar_{4-3}$ are respectively a substituted or unsubstituted aryl group, where the substituent is an alkyl group, an alkoxy group or a halogen atom;

(5)

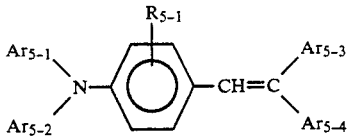

where $Ar_{5-1}$, $Ar_{5-2}$, and $Ar_{5-3}$ are respectively a substituted or unsubstituted aryl group; $Ar_{5-4}$ is a hydrogen atom or a substituted or unsubstituted aryl group; $Ar_{5-3}$ and $Ar_{5-4}$ may form a ring by linking together; $R_{5-1}$ is a hydrogen atom, a substituted or unsubstituted alkyl group, or a halogen atom.

* * * * *

UNITED STATES PATENT AND TRADEMARK OFFICE

CERTIFICATE OF CORRECTION

PATENT NO. : 5,332,635

DATED : July 26, 1994

INVENTOR(S) : HISAMI TANAKA

It is certified that error appears in the above-identified patent and that said Letters Patent is hereby corrected as shown below:

ON THE TITLE PAGE:

AT [30] FOREIGN APPLICATION PRIORITY DATA insert, --[30] Foreign Application Priority Data
October 23, 1991 [JP] Japan.....3-302673--.

AT [57] ABSTRACT

Line 6, "charge-transportion" should read --charge-transporting--.

COLUMN 1

Line 31, "Since," should read --Since--.
Line 36, "forms." should read --forces.--.
Line 39, "namely" should read --namely,--.

COLUMN 3

Line 15, "unsubd-" should read --unsub- --.
Line 16, "stitued" should read --stituted--.
Line 60, "the the" should read --the--.

COLUMN 4

Line 11, "$R_{11}$to" should read --$R_{11}$ to--.
Line 55, "unsubdstitued" should read --unsubstituted--.

UNITED STATES PATENT AND TRADEMARK OFFICE

CERTIFICATE OF CORRECTION

PATENT NO. : 5,332,635

DATED : July 26, 1994

INVENTOR(S) : HISAMI TANAKA

It is certified that error appears in the above-identified patent and that said Letters Patent is hereby corrected as shown below:

COLUMN 5

Line 7, "$ArS_{5-1}$, $ArS_{5-2}$, and $ArS_{5-3}$are" should read --$Ar_{5-1}$, $Ar_{5-2}$, and $Ar_{5-3}$ are--.

COLUMN 6

Example (5), " 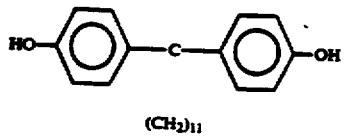 (5) "

should read

-- 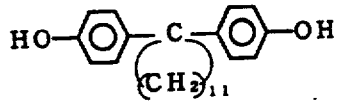 (5) --.

COLUMN 9

Line 47, "Ar" should read --$Ar_{4-1}$,"

COLUMN 10

Line 11, "$R_1$," should read --$R_{6-1}$,--.
Line 32, "$Ar_{7-2}$includes" should read --$Ar_{7-2}$ includes--.
Line 35, "$R_{7-3}$include" should read --$R_{7-3}$ include--.
Line 36, "$R_{7-2}$in-" should read --$R_{7-2}$ in- --.
Line 39, "cludes" should read --clude--.
Line 59, "$Ar_{8-2}$are" should read --$Ar_{8-2}$ are--.

UNITED STATES PATENT AND TRADEMARK OFFICE

CERTIFICATE OF CORRECTION

PATENT NO. : 5,332,635

DATED : July 26, 1994

INVENTOR(S) : HISAMI TANAKA

It is certified that error appears in the above-identified patent and that said Letters Patent is hereby corrected as shown below:

COLUMN 25

Line 36, "0. 50 and 0. 50," should read --0.50 and 0.50,--.

COLUMN 26

Line 62, "C-(3) as" should read --C-(3) was used as--.

COLUMN 31

Line 63, "(3)below;" should read --(3) below;--.
Line 65, "(4)or" should read --(4) or--.
Line 66, "0.6 eV, (1)" should read --0.6 eV, ¶ (1)--.

COLUMN 34

Line 46, "charge transporting" shouldr ead --charge-transporting--.

COLUMN 35

Line 64, "(5)and" should read --(5) and--.
Line 65, "0.6 eV, (1)" should read --0.6 eV, ¶ (1)--.

COLUMN 36

Line 64, "$Ar_{4-3}$are" should read --$Ar_{4-3}$ are--.

UNITED STATES PATENT AND TRADEMARK OFFICE

CERTIFICATE OF CORRECTION

PATENT NO. : 5,332,635

DATED : July 26, 1994

INVENTOR(S) : HISAMI TANAKA

It is certified that error appears in the above-identified patent and that said Letters Patent is hereby corrected as shown below:

COLUMN 37

Line 23, "(3)below;" should read --(3) below;--.

COLUMN 38

Line 42, "a tom;" should read --atom;--.
Line 62, "(3)below;" should read --(3) below;--.
Line 64, "(4)or" should read --(4) or--.

COLUMN 39

Line 11, "$R_{11}$to" should read --$R_{11}$ to--.

COLUMN 40

Line 24, "$Ar_{4-3}$are" should read --$Ar_{4-3}$ are--.
Line 35, "$Ar_{5-3}$are" should read --$Ar_{5-3}$ are--.

Signed and Sealed this

Seventh Day of February, 1995

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,332,635

DATED : July 26, 1994

INVENTOR(S) : HISAMI TANAKA

It is certified that error appears in the above-indentified patent and that said Letters Patent is hereby corrected as shown below:

TITLE PAGE

[73] ASSIGNEE

"Canon Kabushik Kaisha" should read
--Canon Kabushiki Kaisha--

Signed and Sealed this

Eleventh Day of April, 1995

Bruce Lehman

*Attest:*

BRUCE LEHMAN

*Attesting Officer*

*Commissioner of Patents and Trademarks*